US010485353B2

(12) United States Patent
James

(10) Patent No.: US 10,485,353 B2
(45) Date of Patent: Nov. 26, 2019

(54) MATTRESS WITH DIFFERENT FIRMNESS ZONES

(71) Applicant: HMC I.P. HOLDINGS INC., Woodbridge (CA)

(72) Inventor: Michael E. James, Aurora (CA)

(73) Assignee: OWEN & COMPANY LIMITED, Toronto (CA)

( * ) Notice: Subject to any disclaimer, the term of this patent is extended or adjusted under 35 U.S.C. 154(b) by 0 days.

(21) Appl. No.: 16/173,606

(22) Filed: Oct. 29, 2018

(65) Prior Publication Data

US 2019/0059605 A1 Feb. 28, 2019

Related U.S. Application Data

(63) Continuation of application No. 14/746,250, filed on Jun. 22, 2015, now abandoned, which is a continuation of application No. 11/853,945, filed on Sep. 12, 2007, now Pat. No. 9,060,617.

(30) Foreign Application Priority Data

Sep. 26, 2006 (CA) ..... 2558743

(51) Int. Cl.
*A47C 27/15* (2006.01)
*A47C 27/04* (2006.01)

(52) U.S. Cl.
CPC ..... *A47C 27/04* (2013.01)

(58) Field of Classification Search
CPC ..... A47C 27/15
USPC ..... 5/722–723, 727, 738, 655.8, 740, 655.9
See application file for complete search history.

(56) References Cited

U.S. PATENT DOCUMENTS

| | | | | |
|---|---|---|---|---|
| 1,528,066 A | | 3/1925 | McEntire | |
| 2,629,111 A | | 2/1953 | Korney | |
| 3,534,417 A | | 10/1970 | Boyles | |
| 4,449,261 A | | 5/1984 | Magnusson | |
| 4,907,309 A | * | 3/1990 | Breckle | A47C 27/063 5/718 |

(Continued)

FOREIGN PATENT DOCUMENTS

| | | |
|---|---|---|
| CA | 2290244 A1 | 5/2000 |
| CA | 2223750 | 11/2001 |
| EP | 0244028 A1 | 11/1987 |

OTHER PUBLICATIONS

Office Action dated Nov. 3, 2015 for U.S. Appl. No. 14/746,250, filed Jun. 22, 2015.

(Continued)

*Primary Examiner* — Fredrick C Conley
(74) *Attorney, Agent, or Firm* — Schmeiser, Olsen & Watts, LLP

(57) ABSTRACT

A mattress has a perimeter rail having a head end, a foot end, and two sides, each having an inner surface, and at least two substantially parallel rectilinear sections. Each section comprises an array of springs whose tension is selected to provide a predetermined firmness for that section. Each adjacent pair of sections is urged into a spaced-apart relationship by a spacing means, where each spacing means comprises a flexible spacer. The flexible spacer restricts or substantially eliminates the translation of movements between the sections of the mattress, while avoiding the use of uncomfortable separation means.

18 Claims, 2 Drawing Sheets

(56) References Cited

U.S. PATENT DOCUMENTS

| | | | | |
|---|---|---|---|---|
| 5,040,255 | A * | 8/1991 | Barber, Jr. | A47C 27/05 5/718 |
| 5,065,485 | A | 11/1991 | Zocco | |
| 5,740,574 | A * | 4/1998 | Piraino | A47C 27/001 5/716 |
| 6,055,689 | A | 5/2000 | Cavazos | |
| 6,065,168 | A | 5/2000 | Damron | |
| 6,463,610 | B1 | 10/2002 | Shulte et al. | |
| 6,484,338 | B1 | 11/2002 | Hagglund | |
| 9,060,617 | B2 | 6/2015 | James | |
| 2004/0133988 | A1 * | 7/2004 | Barber | A47C 27/064 5/716 |
| 2004/0255387 | A1 | 12/2004 | England | |
| 2005/0066446 | A1 | 3/2005 | Gladney | |
| 2008/0072382 | A1 | 3/2008 | James | |
| 2008/0098533 | A1 | 5/2008 | Erdman | |
| 2015/0282633 | A1 | 10/2015 | James | |

OTHER PUBLICATIONS

Office Action dated Jul. 15, 2016 for U.S. Appl. No. 14/746,250, filed Jun. 22, 2015.
Advisory Action dated Jan. 12, 2017 for U.S. Appl. No. 14/746,250, filed Jun. 22, 2015.
Examiner's Answer dated Jun. 1, 2017 for U.S. Appl. No. 14/746,250, filed Jun. 22, 2015.
Decision on Appeal dated Aug. 30, 2018 for U.S. Appl. No. 14/746,250, filed Jun. 22, 2015.

* cited by examiner

MATTRESS WITH DIFFERENT FIRMNESS ZONES

RELATED APPLICATION

This application is a continuation of U.S. application Ser. No. 14/746,250 filed Jun. 22, 2015, which is a continuation of U.S. application Ser. No. 11/853,945, filed Sep. 12, 2007, and issued as U.S. Pat. No. 9,060,617 on Jun. 23, 2015, entitled "MATTRESS WITH DIFFERENT FIRMNESS ZONES," which claims priority to Canadian application no. 2558743 filed on Sep. 26, 2006.

FIELD OF THE INVENTION

This invention relates to a spring coil mattress system having distinct sections, with reduced translation of movement between the sections.

BACKGROUND OF THE INVENTION

Spring coil mattresses have been known in the art for many years, in which a layer of spring coils is covered with layers of soft material and enclosed in an outer cover. In recent years most commonly a foam is used, or natural and/or synthetic fibers. The rationale behind spring coil mattresses is that a layer of spring coils compresses according to a user's body weight and shape to provide the user with a comfortable undisturbed sleep. It is known to provide different sections where each section has a different level of firmness to accommodate more than one user. For example, Ayers, CA 2,223,750 discloses a unitary mattress assembly comprising spring coils, having two regions, the springs of which have pre-selected compressive strengths. However, while each individual is sleeping on a section of mattress of his/her own firmness preference, each individual may still feel the movements of the other person also lying on the same mattress, resulting in a disturbed sleep.

Mattress constructions have also been proposed where either a second zone of firmness or a space separates two zones of a mattress. Gladney, US Patent Application Publication 2005/0066446 discloses a mattress containing a longitudinal central zone of reduced firmness, between the two primary zones, with the purpose of avoiding the emergence of a central ridge in the mattress that would normally develop due to repeated use of the mattress. The central zone of reduced firmness may be manufactured from open coil springs, pocket springs and/or foam and may be supplemented by variations in the covering materials over that central zone. Damron, U.S. Pat. No. 6,065,168 discloses an independent suspension mattress that has an opening comprised of a discontinuity of the lateral rows of springs along part of a longitudinal centre line of the mattress, so as to provide some independence of sleeping sections on either side of the opening.

Other constructions include mattresses of different firmness zones where a divider or barrier separates the zones of differing firmness. Korney, U.S. Pat. No. 2,629,111 discloses a mattress comprising two longitudinal sections which are constructed as separate inner spring units, each enclosed within intermediate cover fabrics, and separated by a fabric partition. The mattress has outer covering materials which enclose the two units and to which the fabric partition is attached. England, US Patent Application Publication 2004/0255387 discloses a mattress with an accessible interior cavity in which a divider separates the interior cavity into lateral halves. Each of the lateral halves is operable to receive interchangeable auxiliary support members to provide a desired level of comfort for a user of each of the two halves of the mattress.

It is known to provide for variations in air pressure within sections of a mattress; and the use of a barrier with respect to an air mattress is disclosed in Schulte et al., PCT Publication WO 02/09554 which discloses a multi-chamber airbed intended to reduce the effect of weight movements by one or more persons sleeping on the airbed. The airbed comprises at least two independent chambers that are completely sealed off from each other by a barrier or septum connected to the top and bottom sheets of the airbed.

Although the above constructions physically separate the two sections of a mattress, each individual may still feel the movements of the other person also lying on the same spring coil mattress, resulting in a disturbed sleep. What is therefore needed is a spring coil mattress, which restricts or substantially eliminates the translation of a user's movement from one section of the mattress to another section of the mattress and also protects a user from injury or discomfort without restricting the user's ability to move across sections of the mattress.

SUMMARY OF THE INVENTION

The present invention seeks to provide a unitary mattress in which a spacing means between the sections of the mattress provides significant restriction on the translation of movement between the sections, without creating a barrier between the sections, and allowing for the selection of firmness for each section. The firmness for the two sections can be the same or different.

The present invention seeks to provide a mattress comprising a perimeter rail and at least two rectilinear sections that are aligned substantially parallel to each other. The perimeter rail has a head end, a foot, and two sides, each of which has an inner surface. Each section is at least attached to the inner surfaces of the head end and the foot end of the perimeter rail. The sections and the perimeter rail are attached at their respective lower faces to a lower resilient layer and at their respective upper faces to an upper resilient layer. Each section comprises an array of springs, which are vertically disposed when the mattress is oriented in a position ready for use. The tension of the array of springs for each section is selected to provide a predetermined firmness for that section according to a user's preference. Each adjacent pair of sections is urged into a spaced-apart relationship by a spacing means, where the spacing means comprises a flexible spacer which is retained along its length between the upper and lower resilient layers and is attached at its end to the perimeter rail.

According to a first broad aspect, the present invention therefore seeks to provide a mattress comprising: (i) a perimeter rail having a head end, a foot end, and two sides, each having an inner surface; and (ii) at least two rectilinear sections wherein: each section is attached at least to the inner surfaces of the head end and the foot end of the perimeter rail; the sections are aligned substantially parallel to each other; the sections and the perimeter rail are attached at respective lower faces to a lower resilient layer and at their upper faces to an upper resilient layer; each section comprises an array of springs vertically disposed when in a use position; and each adjacent pair of sections is urged into a spaced-apart relationship by a spacing means; wherein (a) tension of the array of springs for each section is selected to provide a predetermined firmness for that section; and (b) each spacing means comprises a flexible spacer which is retained along its length between the upper and lower resilient layers and is attached at its ends to the perimeter rail.

Preferably, the array of springs in each section also comprises a plurality of sub-arrays of springs, where each sub-array has a pre-selected tension to provide a plurality of different firmness zones within that section. An individual skilled in the art will readily recognize that the various firmness zones may be of different sizes.

Preferably, the upper and lower resilient layers are constructed of foam, where the foam is selected from a group consisting of latex, polyurethane, and visco-elastic memory foam (identified generally herein as "visco").

Preferably, at least one of the upper and lower resilient layers are manufactured from dense fibers.

Preferably, the flexible spacer is constructed of foam.

Preferably, a height of the array of springs in an uncompressed position exceeds a height of the perimeter rail.

Preferably, the flexible spacer is attached along its length to the adjacent array of coil springs.

Preferably, the mattress comprises a second upper resilient layer. The second upper resilient layer is constructed of foam, where the foam is selected from a group consisting of latex, polyurethane, and visco.

Preferably, the second upper resilient layer is manufactured from dense fibers.

The advantages of the flexible spacer are that it: (1) restricts or substantially eliminates the translation of a user's movement from one section of the mattress to another section of the mattress, and (2) protects a user from injury without restricting their ability to move across sections of the mattress.

BRIEF DESCRIPTION OF THE DRAWINGS

The embodiments of the present invention will now be described by reference to the following figures, in which.

DETAILED DESCRIPTION OF THE DRAWINGS

Figure 1:
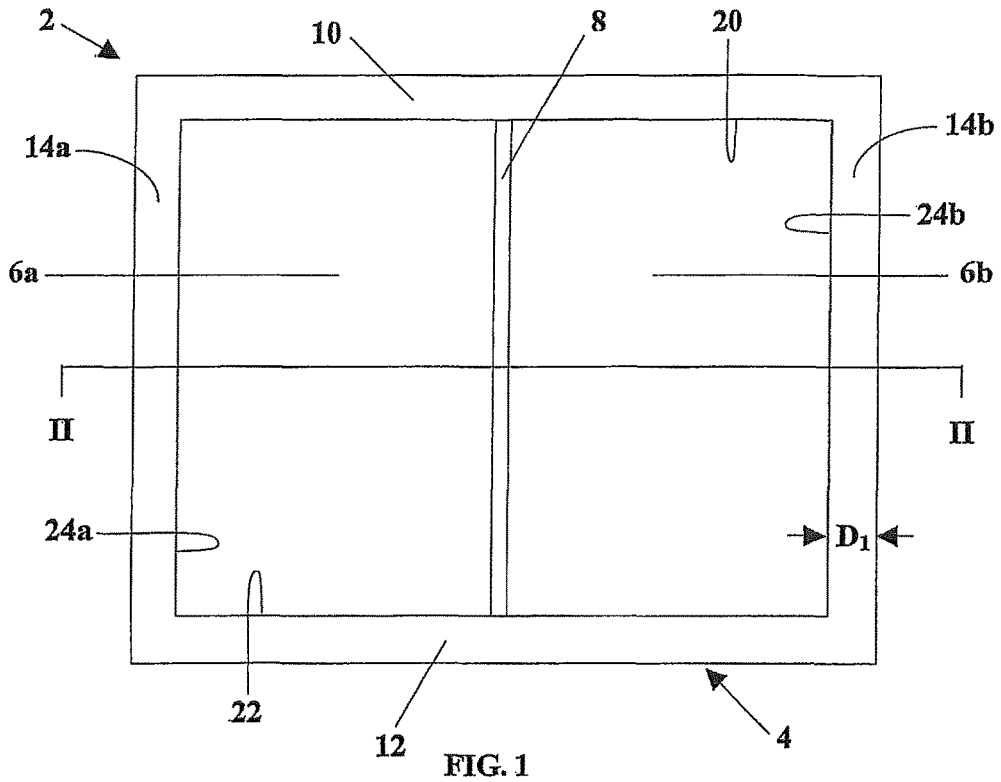
FIG. 1 is a top view of a mattress in accordance with a first embodiment of the invention.
Figure 2:
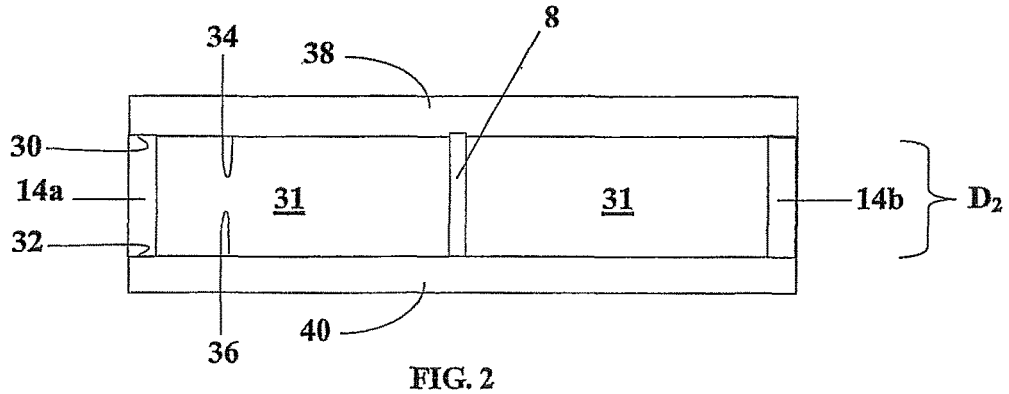
FIG. 2 is a sectional view of the mattress of FIG. 1, taken along line II-II.

Referring to FIGS. 1 and 2, a mattress 2 comprising a perimeter rail 4, two rectilinear sections 6*a* and 6*b*, and a spacing means comprising a flexible spacer 8 is shown. The perimeter rail 4 is composed of a head end 10, a foot end 12, and two sides 14*a* and 14*b*. The head end 10 has an inner surface 20 and the foot end 12 has an inner surface 22. The side ends 14*a* and 14*b* have an inner surface 24*a* and 24*b*. The width of the perimeter rail 4 is represented in FIG. 1 by $D_1$ and the height of the perimeter rail 4 is represented in FIG. 2 by $D_2$. The dimensions of the width $D_1$ and the height $D_2$ can be varied depending on the intended dimensions of the mattress, but it is particularly appropriate to use the standard dimensions, for example a width $D_1$ of 3.5 inches and a height $D_2$ of 5⅝ inches.

Referring again to FIG. 1, the sections 6*a* and 6*b* lie substantially parallel to each other and are attached to at least the inner surface 20 of the head end 10 and to the inner surface 22 of the foot end 12, of the perimeter rail 4.

Referring again to FIG. 2, the two rectilinear sections 6*a* and 6*b* comprise an array of springs 31 (not shown in detail) that are vertically disposed when in a use position. Arrays of springs in mattresses are well understood by those skilled in the art. The tension of the array of springs 31 for each of the sections 6*a* and 6*b* is selected to provide a predetermined firmness for each of the sections 6*a* and 6*b*. The height of the array of springs 31 and the height $D_2$ of the perimeter rail 4 can be varied, but are best suited where the array of springs 31 has a height in an uncompressed position that exceeds the height $D_2$ of the perimeter rail 4. When a user is lying upon the mattress 2, the array of springs 31 compress slightly due to the user's weight. If the height of the array of springs 31 in an uncompressed position does not exceed the height $D_2$ of the perimeter rail 4, a user whose body extends beyond the length of the mattress 2 when lying down (and therefore compressing the array of springs 31) may come into contact with the perimeter rail 4 and cause the user to suffer discomfort. Also, if a user is sitting on the edge of the mattress 2, contact of his/her legs with the perimeter rail 4 may cause discomfort. Therefore, it is preferable to provide for the height of the array of springs 31 in an uncompressed position to be greater than the height of the perimeter rail 4. Preferably, standard heights are selected, for example a height of 6.5 inches for the array of springs 31 and a height of 5⅝ inches for the perimeter rail 4.

Figure 3:
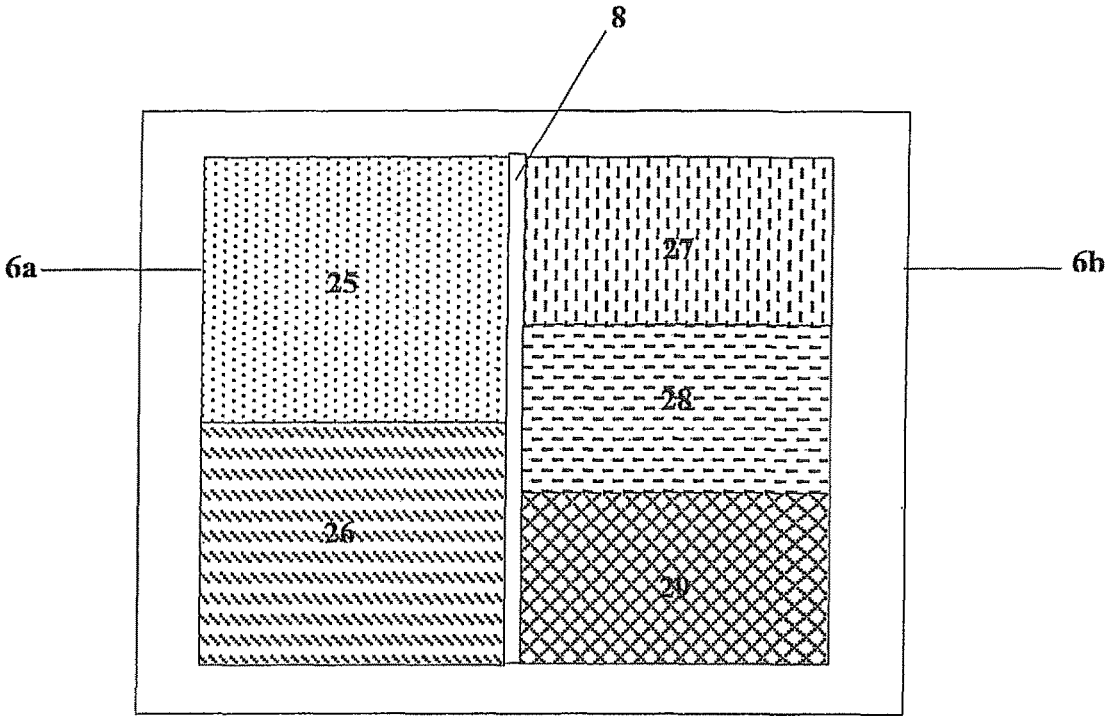
FIG. 3 is a top view of a mattress in accordance with a second embodiment of the invention.

Referring to FIG. 3, the array of springs 31 (shown in FIG. 2) comprises a plurality of sub-arrays of springs (not shown in detail). Each sub-array of springs has a pre-selected tension to provide a plurality of different firmness zones within the sections 6*a* and 6*b*. In the example shown, section 6*a* has two different firmness zones 25 and 26 and section 6*b* has three different firmness zones 27, 28, and 29. A person skilled in the art will readily recognize that the number and size of the different firmness zones may be varied, with any reasonable combination of zones such as those exemplified in FIG. 3.

Referring again to FIG. 2, the perimeter rail 4 further contains an upper face 30 and a lower face 32 and the sections 6*a* and 6*b* further contain an upper face 34 and a lower face 36. The upper face 30 of the perimeter rail 4 and the upper face 34 of the sections 6*a* and 6*b* are attached to an upper resilient layer 38. The lower face 32 of the perimeter rail 4 and the lower face 36 of the sections 6*a* and 6*b* are attached to a lower resilient layer 40. The upper resilient layer 38 and the lower resilient layer 40 are constructed of any suitable resilient and durable material, for example foam, such as latex, polyurethane, or visco. In one variant, at least one of the upper resilient layer 38 and the lower resilient layer 40 is manufactured from dense fibers. Variations in the covering materials can be made, using known construction methods. For example a second upper resilient layer can be provided, which can be constructed of any suitable resilient and durable material, for example foam, such as latex, polyurethane, or visco. Alternatively, the second upper resilient layer can be manufactured from dense fibers.

The flexible spacer 8 is positioned between the sections 6*a* and 6*b* and keeps adjacent sections 6*a* and 6*b* separated. The flexible spacer 8 may be constructed of any suitable resilient and durable material, for example foam. The flexible spacer 8 is retained along its length between the upper resilient layer 38 and the lower resilient layer 40, and at its end to the perimeter rail 4. Optionally, the flexible spacer 8 may be attached along its length to the adjacent array of springs 31. The width of the flexible spacer 8 is selected according to its material of construction so as to provide semi-rigidity, to optimise the restriction on translation of movement between the adjacent sections 6*a* and 6*b*. However it has been found that for the construction of the mattress of the invention, the width of the flexible spacer 8 can be surprisingly small, generally significantly less than the width $D_1$ of the perimeter rail 4.

While the invention has been particularly shown and described with reference to the preferred embodiments thereof, it will be understood by those skilled in the art that various changes in form and detail may be made without departing from the spirit and scope of the invention.

What is claimed is:

1. A mattress comprising:

an upper resilient layer;

a lower resilient layer;

a perimeter rail located between the upper and lower resilient layers and having a head end and a foot end, the perimeter rail comprising first and second side rails each having a width and arranged between the head end and the foot end;

two support sections located within the perimeter rail between the head end and the foot end; and a flexible spacer positioned between the two support sections and retained along its length between the upper and lower resilient layers, a first end of the flexible spacer retained at the head end of the perimeter rail and a second end of the flexible spacer retained at the foot end of the perimeter rail, wherein a width of the flexible spacer is at most half of the width of the side rails.

2. The mattress of claim 1, wherein a width of the flexible spacer is selected to restrict translation of movement between adjacent support sections.

3. The mattress of claim 1, wherein the two support sections are aligned substantially parallel to each other in a horizontally adjacent relationship.

4. The mattress of claim 1, wherein the two support sections each comprise an array of springs.

5. The mattress of claim 4, wherein each of the array of springs provide a respective predetermined firmness for each of the two support sections.

6. The mattress of claim 4, wherein each of the array of springs comprise a plurality of rows of individual springs each having an associated height.

7. The mattress of claim 6, wherein the height of one or more of the rows of springs in each of the spring arrays is greater than a height of the perimeter rail.

8. The mattress of claim 6, wherein the associated height of one or more of the rows of springs in each of the spring arrays is greater than a height of the flexible spacer.

9. The mattress of claim 4, wherein each of the array of springs comprises springs of a plurality of different tensions.

10. The mattress of claim 4, wherein the flexible spacer is attached to each of the array of springs of the two support sections along at least a portion of a length of the flexible spacer.

11. The mattress of claim 1, wherein each of the two support sections are attached to an inner surface of the head end of the perimeter rail and to an inner surface of the foot end of the perimeter rail.

12. The mattress of claim 1, wherein the each of the two support sections are attached at respective lower faces to the lower resilient layer and at respective upper faces to the upper resilient layer.

13. The mattress of claim 1, wherein the perimeter rail is attached at a lower face to the lower resilient layer and at an upper face to the upper resilient layer.

14. The mattress of claim 1, wherein a height of the flexible spacer and a height of the perimeter rail are the same.

15. The mattress of claim 1, wherein a height of the flexible spacer and a height of the perimeter rail are different.

16. The mattress of claim 1, wherein at least one of the upper resilient layer and the lower resilient layer are made of foam.

17. The mattress of claim 1, wherein at least one of the upper resilient layer and the lower resilient layer are made of dense fibers.

18. The mattress of claim 1, further comprising:

an additional support section located within the perimeter rail between the head end and the foot end; and an additional flexible spacer located between the additional support section and one of the two support sections, an end of the additional flexible spacer retained at the flexible spacer and an opposite of the additional flexible spacer retained at a side rail of the perimeter rail.

* * * * *